US007945979B1

(12) United States Patent
Lin

(10) Patent No.: US 7,945,979 B1
(45) Date of Patent: May 24, 2011

(54) MATTRESS WITH AIRFLOW-CIRCULATING FUNCTION

(76) Inventor: Chao-Liang Lin, Qingshui Township (TW)

( * ) Notice: Subject to any disclaimer, the term of this patent is extended or adjusted under 35 U.S.C. 154(b) by 0 days.

(21) Appl. No.: 12/907,093

(22) Filed: Oct. 19, 2010

(51) Int. Cl.
*A47C 21/04* (2006.01)
*A61G 7/057* (2006.01)

(52) U.S. Cl. ..... 5/726; 5/652.2; 5/423

(58) Field of Classification Search ..... 5/726, 724, 5/423, 421, 652.2, 652.1, 284, 713, 710, 5/655.3, 654, 644
See application file for complete search history.

(56) References Cited

U.S. PATENT DOCUMENTS 3,486,177 A * 12/1969 Marshack ..... 5/726
4,864,671 A * 9/1989 Evans ..... 5/713
5,109,560 A * 5/1992 Uetake ..... 5/713
6,216,299 B1 * 4/2001 Kohlman ..... 5/654
6,668,405 B1 * 12/2003 Kohlman ..... 5/654
7,392,557 B1 * 7/2008 Kohlman ..... 5/654

* cited by examiner

*Primary Examiner* — Robert G Santos
(74) *Attorney, Agent, or Firm* — Alan Kamrath; Kamrath & Associates PA

(57) ABSTRACT

A mattress with airflow-circulating function has a main body and a ventilator. The main body has a crisscross groove formed in the main body. The ventilator is detachably connected with the main body and has a hollow joint, four extending tubes and a curved tube. The joint has five openings. The extending tubes are respectively and securely connected to four of the openings of the joint to form a cross and are mounted in the groove. Each extending tube has multiple apertures formed in the extending tube. The curved tube is securely connected to the other one of the openings of the joint and is mounted through the main body. Accordingly, air can be pumped into the joint and is ejected out from the apertures toward the part of the human body. Therefore, the circulating airflow can massage the part of the human body, relieve the pressure and facilitate blood circulation.

4 Claims, 4 Drawing Sheets

MATTRESS WITH AIRFLOW-CIRCULATING FUNCTION

BACKGROUND OF THE INVENTION

1. Field of the Invention

The present invention relates to a mattress with airflow-circulating function, and more particularly to a mattress with airflow-circulating function for providing a massage effect to relieve pressure.

2. Description of Related Art

Patients who lie on beds or sit in wheelchairs for a long term are easily subject to suffer from decubitus ulcers due to humidity or unrelieved pressure. A conventional mattress is made of thick and soft material, such as cotton, and is used to be lay by patients to avoid decubitus ulcers. The thickness of the mattress can prevent the human body of the patient from directly touching a hard and solid object, so the human body is not stressed and is comfortable.

However, the relief effect provided by the conventional mattress to the human body of a patient is not sufficient and decubitus ulcers still recur frequently. Therefore, the conventional mattress needs to be further improved.

To overcome the shortcomings, the present invention tends to provide a mattress with airflow-circulating function to mitigate the aforementioned problems.

SUMMARY OF THE INVENTION

The main objective of the invention is to provide a mattress with airflow-circulating function for providing a massage effect to relieve pressure.

A mattress with airflow-circulating function has a main body and a ventilator. The main body has a crisscross groove formed in the main body. The ventilator is detachably connected with the main body and has a hollow joint, four extending tubes and a curved tube. The joint has five openings. The extending tubes are respectively and securely connected to four of the openings of the joint to form a cross and are mounted in the groove. Each extending tube has multiple apertures formed in the extending tube. The curved tube is securely connected to the other one of the openings of the joint and is mounted through the main body. Accordingly, air can be pumped into the joint and is ejected out from the apertures toward the part of the human body. Therefore, the circulating airflow can massage the part of the human body, relieve the pressure and facilitate blood circulation.

Other objects, advantages and novel features of the invention will become more apparent from the following detailed description when taken in conjunction with the accompanying drawings.

DETAILED DESCRIPTION OF PREFERRED EMBODIMENT

Figure 1:
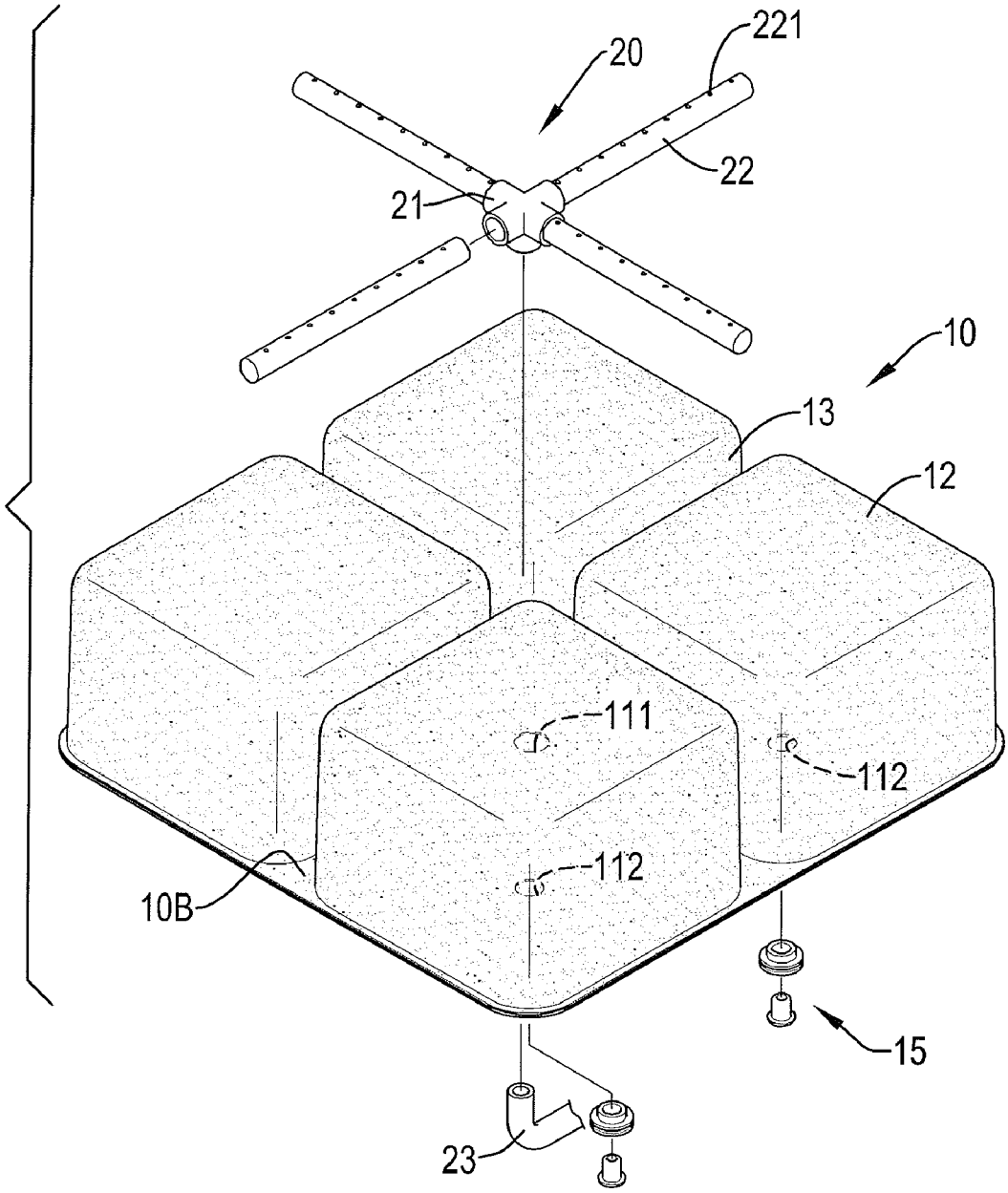
FIG. 1 is an exploded perspective view of a mattress with airflow-circulating function in accordance with the present invention.
Figure 2:
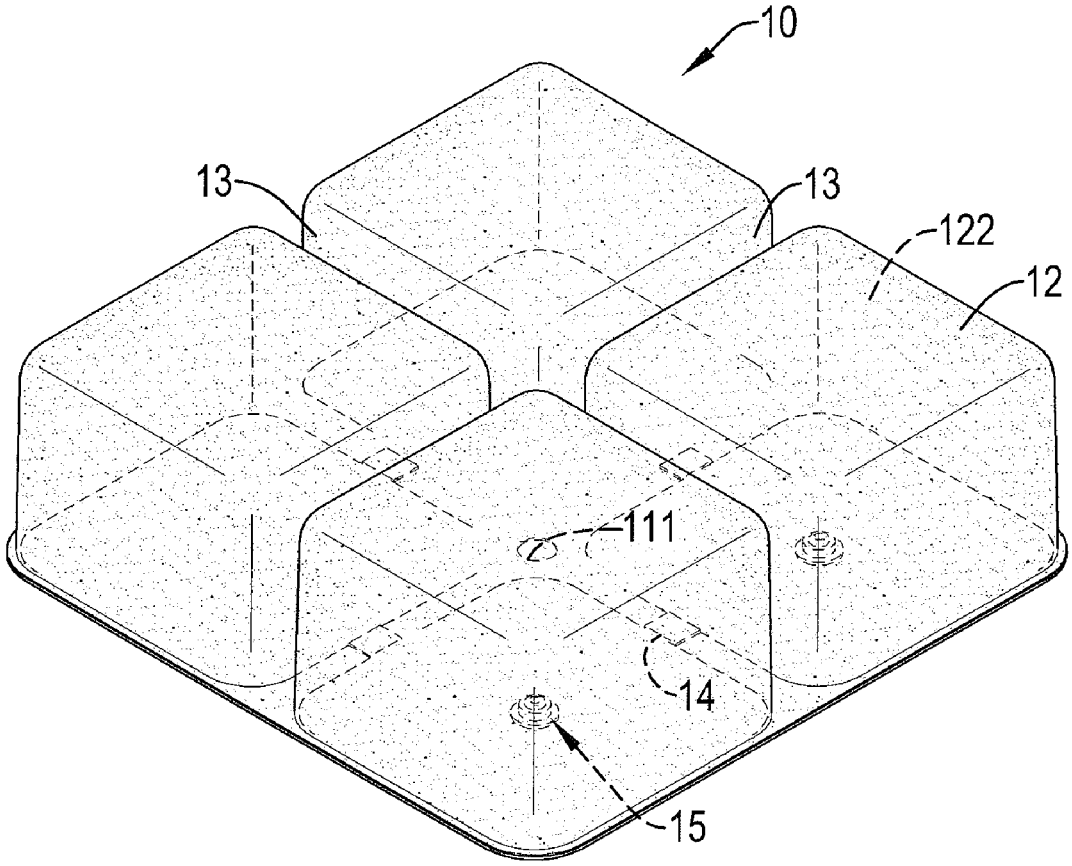
FIG. 2 is a perspective view of the main body of the mattress with airflow-circulating function in FIG. 1.
Figure 3:
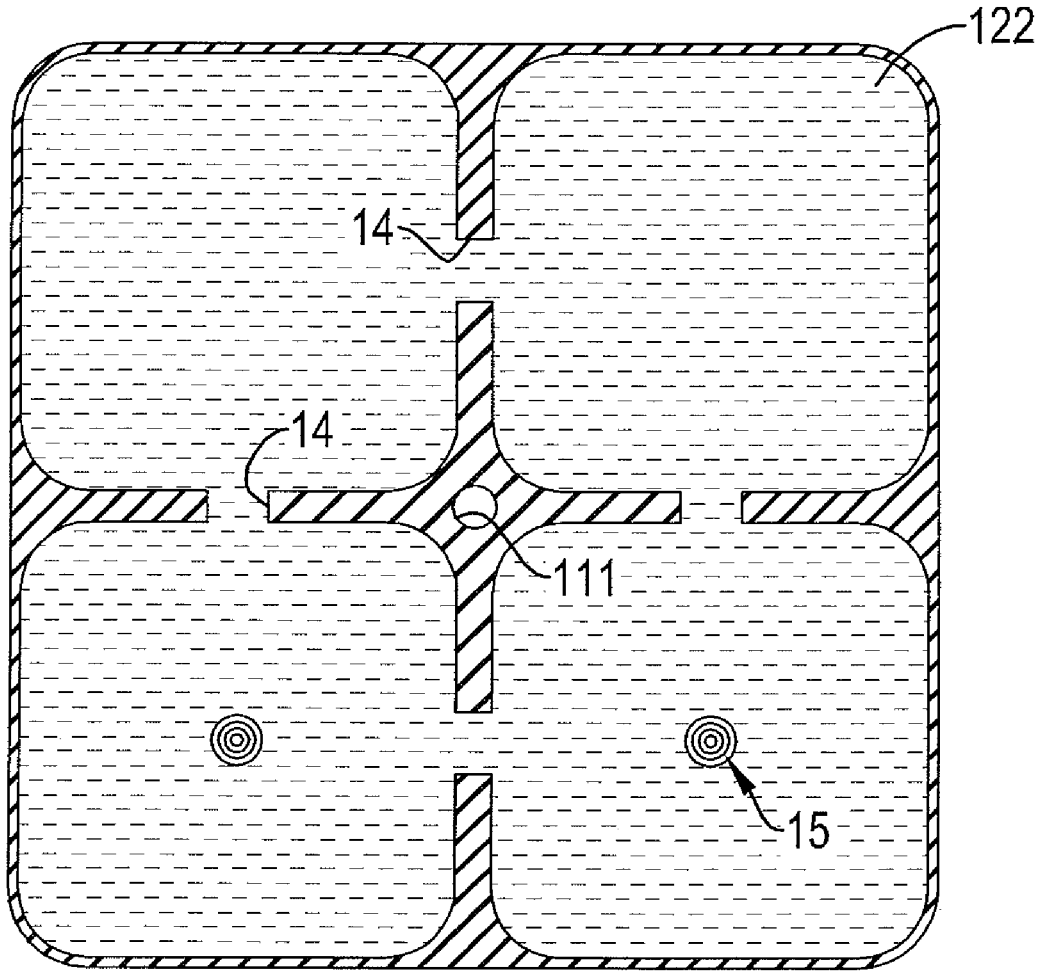
FIG. 3 is a cross sectional top view of the main body of the mattress with airflow-circulating function in FIG. 2.

With reference to FIGS. 1 to 4, a mattress with airflow-circulating function in accordance with the present invention comprises a main body 10 and a ventilator 20.

The main body 10 is made of plastics or rubber and has a center, a first surface 10A, a second surface 10B, a through hole 111, two plug holes 112, four cushions 12, a groove 13, four passages 14 and two plugs 15.

The second surface 10B of the main body 10 is opposite to the first surface 10A of the main body 10. The through hole 111 is formed through the center of the main body 10. The plug holes 112 are formed though the first surface 10A beside the through hole 111.

The cushions 12 are formed on and protrude from the second surface 10B of the main body 10 and are arranged as a matrix. Each cushion 12 is hollow and has an inner space 122. The plug holes 112 make two inner spaces 122 of the cushions 12 communicating with the atmosphere. Each passage 14 is located between adjacent two of the cushions 12 to make the inner spaces 122 of the adjacent two cushions 12 communicating with each other.

The groove 13 is crisscross, is formed at gaps among the cushions 12 and has a center. The center of the groove 13 aligns with the through hole 111 of the main body 10. The plugs 15 are respectively mounted securely and detachably in the plug holes 112. Accordingly, water may be poured into the inner spaces 122 of the cushions 12 via the plug holes 112 and the passages 14. The plugs 15 close the plug holes 112 for prevention of water's leakage. Therefore, water in the cushions 12 can lower the temperature of the part of the human body which is in contact with the cushions 12 and relieve the sticky uncomfortableness.

The ventilator 20 is detachably connected with the main body 10 and has a joint 21, four extending tubes 22 and a curved tube 23. The joint 21 is hollow and has five openings. The extending tubes 22 are respectively and securely connected to four of the openings of the joint 21 to form a cross and are mounted in the groove 13. Each extending tube 22 has multiple apertures 221 radially formed in the extending tube 22. The curved tube 23 is securely connected to the other one of the openings of the joint 21 and is mounted through the through hole 111 of the main body 10. The joint 21, the extending tubes 22 and the curved tube 23 may be formed integrally as a single part.

Figure 4:
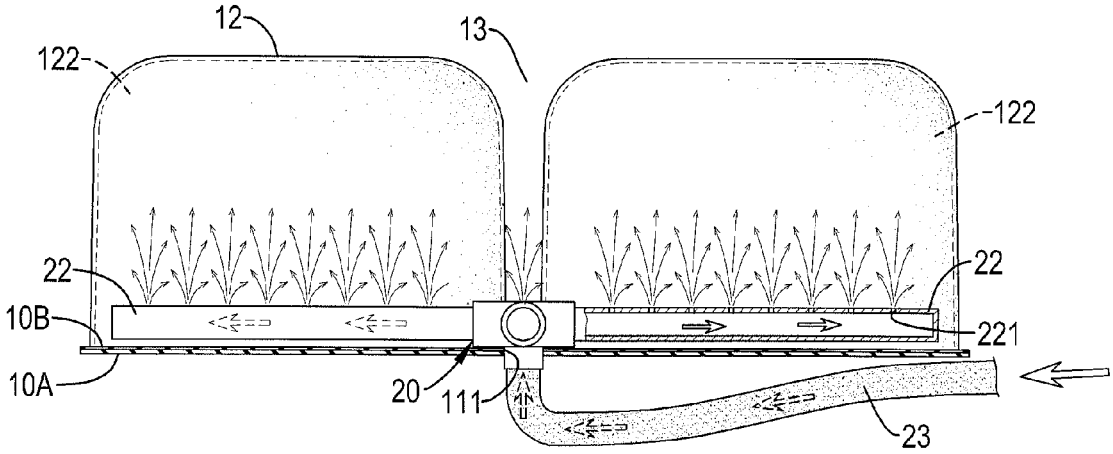
FIG. 4 is an operational side view in partial section of the mattress with airflow-circulating function in FIG. 1.

With reference to FIGS. 1 and 4, air can be pumped into the joint 21 via the curved tube 23 by a pump and be ejected out from the apertures 221 toward the human body. Therefore, the circulating airflow can massage the part of the human body, such as the buttocks, and be beneficial to blood circulation. Moreover, furfures are easily removed from the groove 13 or the cushions 12 and the main body 10 is easily cleaned because the ventilator 20 is detachably connected with and easily removed from the main body 10. Additionally, to assemble the main body 10 and the ventilator 20 is easy and the cost for manufacturing the main body 10 and the ventilator 20 can be efficiently lowered.

In use, the mattress with airflow-circulating function in accordance with the present invention can be regarded as a unit, and multiple units may be assembled based on different sizes of the part of the human body of the patient or different sizes of beds where patients lie.

From the above description, it is noted that the present invention has the following advantages:

1. Massage Effect Provided by the Circulating Airflow:

Air is pumped into the joint 21 and is ejected out from the apertures 221 toward the part of the human body, such that the circulating airflow can massage the part of the human body, relieve the pressure and facilitate blood circulation.

2. Versatile Assembling:

The mattress with airflow-circulating function in accordance with the present invention can be deemed a unit, and multiple units may be assembled based on different needs of the user so that the mattress in accordance with the present invention is versatile in use.

3. Easy Cleaning:

The main body 10 is easily cleaned to remove furfures from the groove 13 or the cushions 12 with the ventilator 20 being detached from the main body 10.

4. Capability of Lowering the Temperature of the Human Body:

Water in the cushions 12 can lower the temperature of the part of the human body and relieve the sticky uncomfortableness.

5. Reducing Manufacturing Cost:

Molds used for manufacturing a conventional mattress are large and require a high manufacturing cost. The mattress with airflow-circulating function in accordance with the present invention is small and requires small molds, so manufacturing cost of the present invention can be reduced.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mattress with airflow-circulating function comprising:

a main body having a crisscross groove formed in the main body; and a ventilator detachably connected with the main body and having a hollow joint having five openings; and four extending tubes and a curved tube respectively and securely connected to the openings of the joint, wherein the extending tubes are formed as a cross and are mounted in the groove, and each extending tube has multiple apertures formed in the extending tube; and the curved tube is mounted through the main body.

2. The mattress with airflow-circulating function as claimed in claim 1, wherein the main body has a first surface;

a second surface opposite to the first surface of the main body; and four cushions formed on and protruding from the second surface of the main body and arranged as a matrix, wherein the groove is formed at gaps among the cushions.

3. The mattress with airflow-circulating function as claimed in claim 2, wherein the main body has four passages, two plugs and two plug holes which are formed through the first surface of the main body and in which the plugs are respectively mounted securely and detachably;

each cushion is hollow and has an inner space; and each passage is located between adjacent two of the cushions to make the inner spaces of the adjacent two cushions communicating with each other.

4. The mattress with airflow-circulating function as claimed in claim 3, wherein the main body has a through hole which is formed though the main body and through which the curved tube is mounted.

* * * * *